US005249986A

United States Patent [19]

Lu

[11] Patent Number: 5,249,986

[45] Date of Patent: Oct. 5, 1993

[54] SAFETY PLUG

[76] Inventor: Chung-Yin Lu, No. 4, Alley 1, Lane 1483, Chung-Hwa St., Chu-Pei City, Hsin Chu Hsien, Taiwan

[21] Appl. No.: 15,234

[22] Filed: Feb. 9, 1993

[51] Int. Cl.[5] ..... H01R 13/68

[52] U.S. Cl. ..... 439/622; 439/621

[58] Field of Search ..... 439/621, 622; 337/190, 337/194, 198

[56] References Cited

U.S. PATENT DOCUMENTS 4,792,311 12/1988 Wu ..... 439/622

FOREIGN PATENT DOCUMENTS 0940265 6/1982 U.S.S.R. ..... 439/621

*Primary Examiner*—Eugene F. Desmond

[57] ABSTRACT

A safety plug is disclosed having two fuse tubes inserted in a fuse tube chamber on an internal block and squeezed by a projecting rod on a cap to electrically connect the two blades to the terminals of the hot and neutral wires. The fuse tubes automatically moves toward each other in disconnecting the blades from the terminals of the hot and neutral wires, by means of the guide of a concave bottom surface on the fuse tube chamber, as the cap was opened.

1 Claim, 4 Drawing Sheets

SAFETY PLUG

BACKGROUND OF THE INVENTION

The present invention relates to plugs and relates more particularly to a safety plug which is electrically disconnected as a cap thereof was opened for a repair work.

A fuse wire or fuse tube may be used in a plug as an electrical safety device to interrupt the circuit when the current exceeds a particular amperage. However, a safety plug which uses a fuse device for protection against overload is still not satisfactory in function. An electric shock accident may happen during a repair work if power supply is not cut off.

SUMMARY OF THE INVENTION

The main object of the present invention is to provide a safety plug which automatically interrupt the circuit as the housing was opened for a repair work. In the preferred embodiment, two fuse tubes are inserted in a fuse tube chamber and squeezed by a projecting rod on a cap, which covers an opening on the housing of the plug, to electrically connect the blades to the terminals of the hot and neutral wires. As the cap was opened, the fuse tubes are guided by a concave surface to move toward each other, thereby causing the blades to be electrically disconnected from the terminals of the hot and neutral wires.

DETAILED DESCRIPTION OF THE PREFERRED EMBODIMENT

Figure 1:
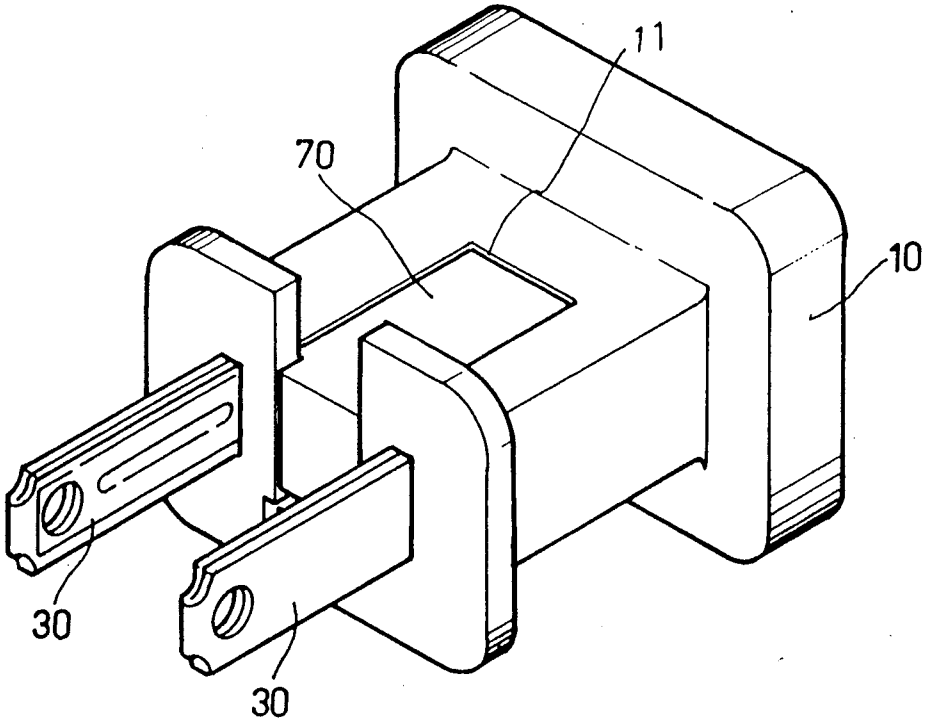
FIG. 1 is an elevational view of a safety plug embodying the present invention.
Figure 2:
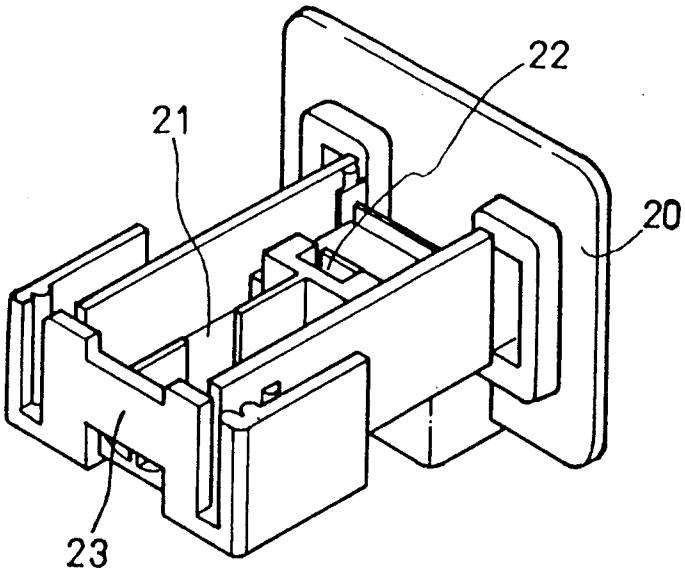
FIG. 2 is an elevational view of the internal block of the safety plug.
Figure 3:
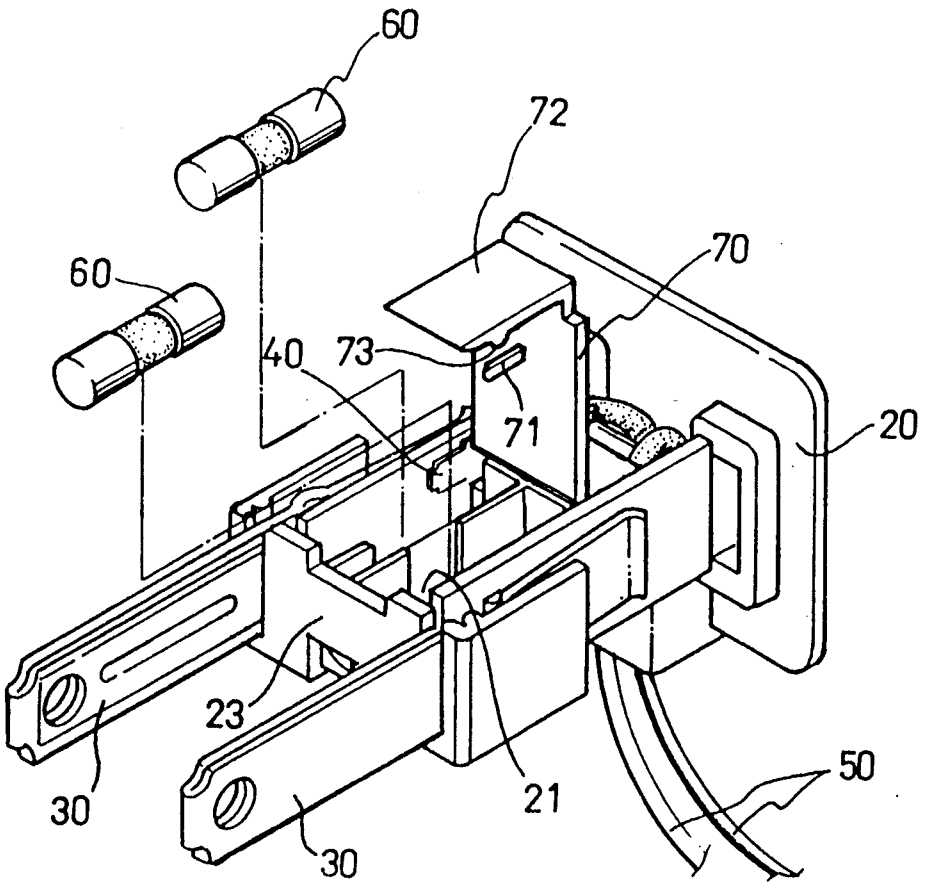
FIG. 3 is an exploded view of the fuse tubes, the cap and the internal block of the safety plug.

Referring to FIGS. 1, 2 and 3, a safety plug as constructed in accordance with the present invention is generally comprised of a housing 10, an internal block 20 received inside the housing, two blades 30 bilaterally fastened to the internal block 20 at the front, two terminals 40 fastened inside the internal block 20, two wires (hot wire and neutral wire) 50 respectively connected to the terminals 40, two fuse tubes 60 fastened inside the internal block 20, and a cap 70. The housing 10 has an opening 11 (not shown) at a suitable location. The internal block 20 comprises a fuse tube chamber 21 surrounded by a front fender 23, and a recessed hole 22 behind the fuse tube chamber 21 for mounting the cap 70. The terminals 40 are respectively connected to the wires 50 and bilaterally fastened inside the fuse tube chamber 21. The fuse tubes 60 are respectively received inside the fuse tube chamber 21. The cap 70 is made with a L-shaped section having a projecting rod 71 perpendicular to a vertical wall thereof and a hook 73 on a horizontal wall 72 thereof at the bottom. As the vertical wall of the cap 70 was inserted in the recessed hole 22 on the internal block 20, the horizontal wall 72 is disposed covered over the opening 11 on the housing 10 with the hook 73 hooked on the front fender 23 of the internal block 20, and at the same time, the fuse tubes 60 are separated by the projecting rod 71. The cap 70 can be conveniently opened with the hand by pulling the horizontal wall 72 in disconnecting the hook 73 from the front fender 23.

Figure 4:
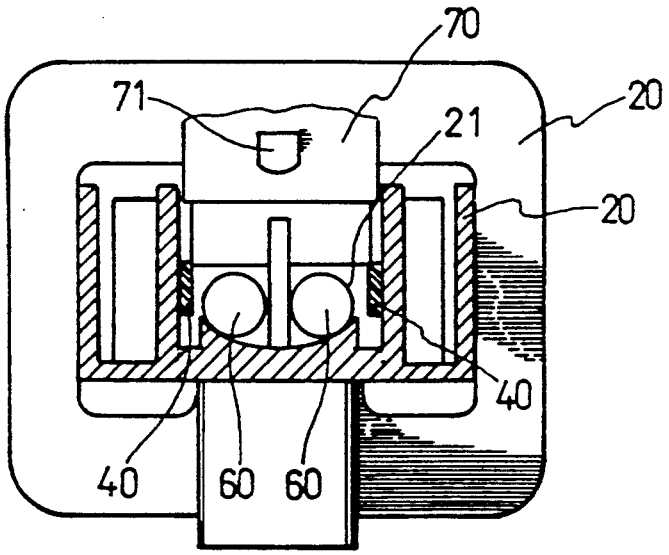
FIG. 4 is a cross section showing the fuse tubes squeezed by the projecting rod to connect the blades to the terminals.

Referring to FIG. 4, the fuse tube chamber 21 has a bottom surface smoothly curved inwards, therefore the fuse tubes 60 automatically move away from the terminals 40 toward the middle (toward each other), once they were inserted, in cutting off the connection between the blades 30 and the wires 50.

Figure 5:
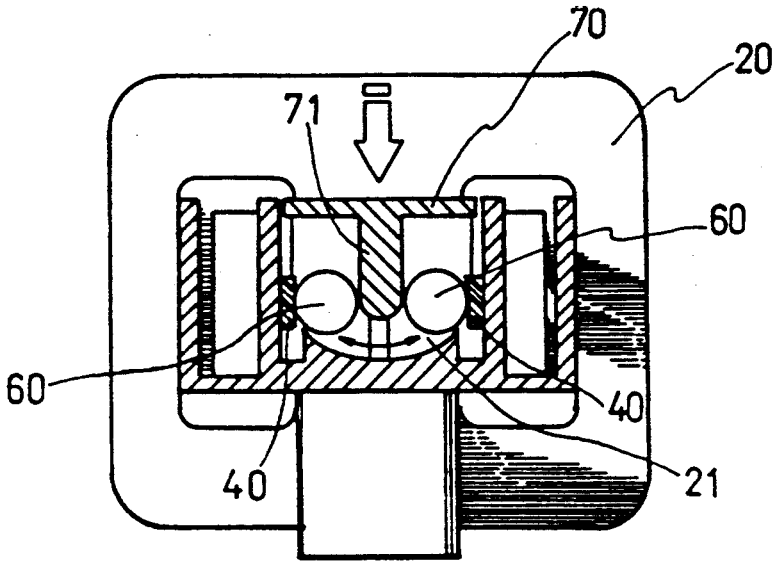
FIG. 5 is another cross section showing the fuse tubes moved toward each other to disconnect the blades from the terminals.

Referring to FIG. 5, once the cap 70 was fastened into place, the fuse tubes 60 are bilaterally squeezed outwards by the projecting rod 71 to electrically and respectively connect the blades 30 to the terminals 40. In other words, the plug is automatically and electrically disconnected as the cap was lifted or opened during a repair work.

What is claimed is:

1. A safety plug comprising a housing, an internal block received inside said housing, two blades bilaterally fastened to said internal block at the front, two terminals fastened inside said internal block and bilaterally spaced from said blades, a hot wire and a neutral wire respectively connected to said terminals, two fuse tubes inserted in a fuse tube chamber on said internal block and forced by a cap on said housing to respectively and electrically connect said terminals to said blades, wherein said fuse tube chamber has a bottom smoothly curved inwards for permitting said fuse tubes to move away from said terminals and said blades toward each other in electrically and automatically disconnecting said blades from said hot and neutral wires once they are inserted before closing of said cap or after said cap was opened; said cap is made with a L-shaped section comprised of horizontal wall covered on an opening on said housing and a vertical wall inserted in a recessed hole on said internal block, said horizontal wall having a hook hooked on a front fender of said internal block for positioning, said vertical wall having a projecting rod moved to squeeze said fuse tubes outwards in electrically and respectively connecting said blades to said terminals as said cap was fastened into place and said horizontal wall covered over the opening on said housing.

* * * * *